US006315388B1

(12) United States Patent
Goh

(10) Patent No.: US 6,315,388 B1
(45) **Date of Patent: *Nov. 13, 2001**

(54) DRAFT PRINTING

(75) Inventor: Guan Kwee Goh, Singapore (SG)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/384,844

(22) Filed: Aug. 27, 1999

(30) Foreign Application Priority Data

Oct. 30, 1998 (SG) ..... 9803849

(51) Int. Cl.[7] ..... B41J 2/145; B41J 2/15; B41J 29/38

(52) U.S. Cl. ..... 347/40; 347/9

(58) Field of Search ..... 347/40, 43, 9, 347/12

(56) References Cited

U.S. PATENT DOCUMENTS

| | | | | |
|---|---|---|---|---|
| 5,604,519 | | 2/1997 | Hewlett-Packard Company | 347/13 |
| 5,831,642 | * | 11/1998 | Matsubara et al. | 347/9 |
| 5,896,146 | | 4/1999 | Murata et al. | 347/42 |
| 5,907,331 | * | 5/1999 | Markham | 347/12 |

FOREIGN PATENT DOCUMENTS

| | | |
|---|---|---|
| 0582432 | 2/1994 | (EP) . |
| 08258292 | 10/1996 | (JP) . |

* cited by examiner

*Primary Examiner*—Thinh Nguyen

(57) ABSTRACT

An improved draft mode for use in a swath-type printer, which enables printing in every printing column, with only half the printing elements being activated in each column.

11 Claims, 9 Drawing Sheets

| | t | t' | t'' | t''' | | |
|---|---|---|---|---|---|---|
| N8 | X | X | X | X | X | X |
| N7 | X | X | X | X | X | X |
| N6 | X | X | X | X | X | X |
| N5 | X | X | X | X | X | X |
| N4 | X | X | X | X | X | X |
| N3 | X | X | X | X | X | X |
| N2 | X | X | X | X | X | X |
| N1 | X | X | X | X | X | X |

*Fig. 2*

| | t | t' | t'' | t''' | | |
|---|---|---|---|---|---|---|
| N8 | X | | X | | X | |
| N7 | X | | X | | X | |
| N6 | X | | X | | X | |
| N5 | X | | X | | X | |
| N4 | X | | X | | X | |
| N3 | X | | X | | X | |
| N2 | X | | X | | X | |
| N1 | X | | X | | X | |

*Fig. 3* (Prior Art)

| | t | t' | t'' | t''' | | |
|---|---|---|---|---|---|---|
| N8 | X | | X | | X | |
| N7 | | X | | X | | X |
| N6 | X | | X | | X | |
| N5 | | X | | X | | X |
| N4 | X | | X | | X | |
| N3 | | X | | X | | X |
| N2 | X | | X | | X | |
| N1 | | X | | X | | X |

*Fig. 4*

DRAFT PRINTING

This invention relates generally to swath-type printers. In particularly, the invention relates to an improved method and printer for printing in a draft mode.

BACKGROUND OF THE INVENTION

A swath printer is a raster or matrix type printer that is capable of printing a plurality of rows of dots in a single scan of a movable print carriage across a print media. The possible locations for dots that can be printed by a raster printer can be represented by an array or grid of pixels or square areas arranged in a rectilinear array of rows and columns wherein the centre to centre distance or dot pitch between pixels is determined by the resolution of the printer. For example, if a printer is capable of printing 300 dots per inch (dpi), the dot pitch of the pixel array would be 1/300th of an inch.

The print carriage of a swath printer typically includes a plurality of printing elements (e.g., ink jet nozzles) displaced relative to each other in the media motion direction which allows printing of a plurality of rows of dots. Typically, the separation between the printing elements in the media scan direction corresponds to the dot pitch for the finest raster row resolution that can be printed by the printer in a single carriage scan (e.g., 1/300th of an inch for 300 dot per inch (dpi) resolution). The printing elements of a swath printer are commonly implemented in a printhead such as a thermal ink jet printhead that is integral to a replaceable thermal ink jet printhead cartridge.

The quality of the printed images produced by a raster printer depends to large degree on the resolution of the printer. Higher or finer resolution, wherein the printed dots are more closely spaced, provides for higher quality images. To increase the resolution and print quality, the ink jet nozzles must be placed closer together. However, the dense packing of printing elements in a printing cartridge causes problems in providing electrical connections to the printing elements and in dispersing heat away from the printing elements. These problems are accentuated when the printing elements are activated or fired simultaneously.

U.S. Pat. No. 5,604,519 describes an ink jet printhead in which the ink jet nozzles are grouped or organised into fourteen primitives. The ink jet nozzles in each primitive are positioned in close proximity to each other and are activated individually (one at a time) according to a timing sequence or cycle. This sequential activation permits sharing of power supply lines and helps to overcome problems associated with firing the nozzles simultaneously.

FIG. 1 shows a simplified version of one of the primitives described in U.S. Pat. No. 5,604,519. The diagram illustrates the layout of eight nozzles in the primitive as viewed from an above the nozzles. The printing elements of the primitive, labelled N1 to N8, are scanned over the print media in a horizontal direction indicated by arrow A. The first printing element N1 is activated for printing by applying, for a predetermined period of time, an electrical power source at a "primitive select" terminal associated with that printing element. Following activation of the first printing element N1, the second printing element N2 is activated for printing by applying an electrical power source at a terminal associated with the second printing element N2. Subsequently, the third, fourth, fifth, sixth, seventh, and eighth printing elements N3, N4, N5, N6, N7, N8 are activated in sequence. During activation of the printing elements, any one of the activated printing element may be selectively fired by applying, at the appropriate moment, a control voltage at an "address select" terminal associated with that printing element.

Each printing element N2 to N8 is spatially offset in the horizontal direction from the preceding numbered printing element, i.e. N2 is offset from N1, N3 is offset from N2, and so on. The size of the offset, indicated as d in FIG. 1, is the same for each printing element N2 to N8. Thus, although the printing elements N1 to N8 are activated at eight different times, the offsets allow ink drops that are selectively fired from the activated printing elements to be placed at the same horizontal position on the print media. As the printing elements are also evenly spaced from each other in the vertical direction, the result of printing at the same horizontal position effectively creates a vertical printing column on the print media. The precise activation timing for each printing element N1 to N8 is based on a timing sequence that is specific to the size of the offset d and the scanning speed of the primitive. Scanning in the horizontal direction indicated by arrow B is also possible, whereby the sequence of activating the printing elements is reversed.

In order for the printing elements to print in a rectilinear array of rows and columns, the sequence of activating the printing elements is repeated or cycled during a single scan. This cycling produces a series of vertical printing columns whose separation in the horizontal direction is equal to the resolution of the printer in that direction. In this way, the printer is able to produce a standard raster or matrix print output on the print media. FIG. 2 shows a rectilinear array of rows and columns on a print media. The X's in FIG. 2 indicate the pixels in the array which the printer can selectively print to in a single scan.

Throughput, i.e. the speed of printing, is an important consideration in the design of a printer. In general, users prefer printers which can print faster. However, the higher the resolution of a printer, the more difficult it is to operate with a high throughput. The maximum scanning speed of a printhead is limited by the highest firing frequency of the printing elements and the separation of the vertical printing columns. The scanning speed may be calculated by dividing the distance travelled between firing a particular printing element (vertical column spacing) by the time interval between firing (reciprocal of firing frequency) or by dividing the firing frequency of the printing elements by the printing resolution in the horizontal direction (in dots-per-inch). An increase in the resolution of a printer results in a decrease in the separation of the vertical printing columns. This decrease, for a particular firing frequency of the printing elements, causes the scanning speed to decrease accordingly. For example, the printhead in U.S. Pat. No. 5,604,519, which has a relatively high resolution of 600 dots-per-inch and a maximum firing frequency of 12 kHz, is able to scan at 20 inches-per-second (ips).

This limitation on the maximum printing speed occurs in existing printers and is overcome by allowing the printer to operate in a mode having a lower resolution. In this mode, commonly referred to as a draft mode, the printer prints in alternate vertical printing columns, i.e. in every other vertical printing column the printing elements are not activated. The HP Deskjet 850, available from Hewlett-Packard, USA, is operable in a draft mode similar to that described above. FIG. 3 shows a rectilinear array of rows and columns on a print media which a printer operating in this draft mode can print to in a single scan. The X's in FIG. 3 indicate the pixels in the array which the printer can selectively print to in the above-mentioned draft mode. In FIG. 3, it can be seen that the resolution of the printer in the direction of the scan axis is halved, which in turn leads to doubling of the distance travelled between successive firings of the printing elements. Consequently, a printer operating in this draft mode has the potentially to print at speeds of up to twice the maximum speed of the standard higher resolution mode.

However, the applicant has found, in practice, that for printers having printing elements which are sequentially activated, the maximum scanning speed in the draft mode is less than twice the maximum speed in the standard mode. This shortfall is the result of a second limitation on the maximum scanning speed caused by the finite firing time of the printing elements. This firing time is the time period that each printing element is activated for during the sequence of activating the printing elements. For a thermal ink jet type of printing element, there is an associated minimum firing time which is determined by the minimum time required for ink in the element to be thermally excited to a vaporised state.

For the primitive shown in FIG. 1, the speed of scanning is equal to the offset distance, d, divided by the time period between firing one of the printing elements and firing the next element (the so-called stagger time). For a particular offset distance, d, the speed of scanning may be increased so as to minimise the stagger time. However, the stagger time cannot be made less than the minimum firing time of the printing elements, otherwise the printing elements cannot be activated individually (one at a time). The maximum scanning speed is thus limited to the offset distance, d, divided by the minimum firing time of the printing elements.

The second limitation is a drawback for printers having printing elements which are sequentially activated as it limits the potential scanning speeds available in a draft mode. Printers having printing elements which are activated simultaneously do not experience the firing time limitation and can thus achieve higher scanning speeds in a draft mode. Printers having printing elements which are sequentially activated are therefore at a competitive disadvantage.

SUMMARY OF THE INVENTION

It is an object of the present invention to provide an improved draft mode for printers in which the above-mentioned drawbacks with the sequential activation of the printing elements are reduced. The improved draft mode may also have advantages with printers in which the printing elements are fired simultaneously.

According to a first aspect of the present invention, there is provided a method of printing in a draft mode in a printer having a group of printing elements that are activated for printing at predetermined column positions along a scan axis in a standard mode. The method comprises activating a first subset of the group of printing elements so as to print at a first set of predetermined positions along a scan axis, and activating a second subset of the group of printing elements so as to print at a second set of predetermined positions along the scan axis, wherein the first and second sets of predetermined positions are spatially interleaved.

Preferably, the group of printing elements are sequentially activated according to a repeated timing cycle in the standard mode, and the first and second subset of the group of printing elements are sequentially activate according to a repeated timing cycle in the draft mode.

Preferably, the printing elements in the first subset comprise the first printing element and every other subsequent printing element activated according to the sequential activation in the standard mode. Preferably, the printing elements in the second subset comprise the second and every other subsequent printing element activated according to the sequential activation in the standard mode. The first subset and the second subset of printing elements are therefore preferably exclusive.

Whereas the prior art draft mode prints in every other printing column, the improved draft mode enables printing in every printing column, with only half the printing elements being activated in each column.

In any one printing column, the printing elements which are activated are offset in the horizontal direction by twice the offset for adjacent printing elements in the group. This increased offset helps to overcome any limitation due to the time taken to separately fire the printing elements in sequence. Consequently, the improved draft mode allows for increased scanning speeds when compared to the prior art draft mode.

In accordance with the invention, the activation of the printing elements in the improved draft mode is distributed more evenly over time. This even distribution allows for improved heat dissipation from the printhead which in turn improves printing performance.

A further advantage in accordance with the improved draft mode is that the printing positions are more homogeneously spaced (chequered pattern) than the printing positions available in the prior art draft mode (striped pattern).

The extent and scope of the present invention is defined in the appended claims to which reference should now be made.

DESCRIPTION OF THE DRAWINGS

FIG. 2 shows a rectilinear array of rows and columns on a print media, with the X's indicating the pixels in the array which the printer can selectively print to in a standard high resolution mode.

FIG. 3 shows a rectilinear array of rows and columns on a print media, with the X's indicating the pixels in the array which the printer can selectively print to in the prior art draft mode.

FIG. 4 shows a rectilinear array of rows and columns on a print media, with the X's indicating the pixels in the array which the printer can selectively print to in the improved draft mode in accordance with the invention.

DETAILED DESCRIPTION OF SPECIFIC EMBODIMENTS OF THE INVENTION

Figure 9:
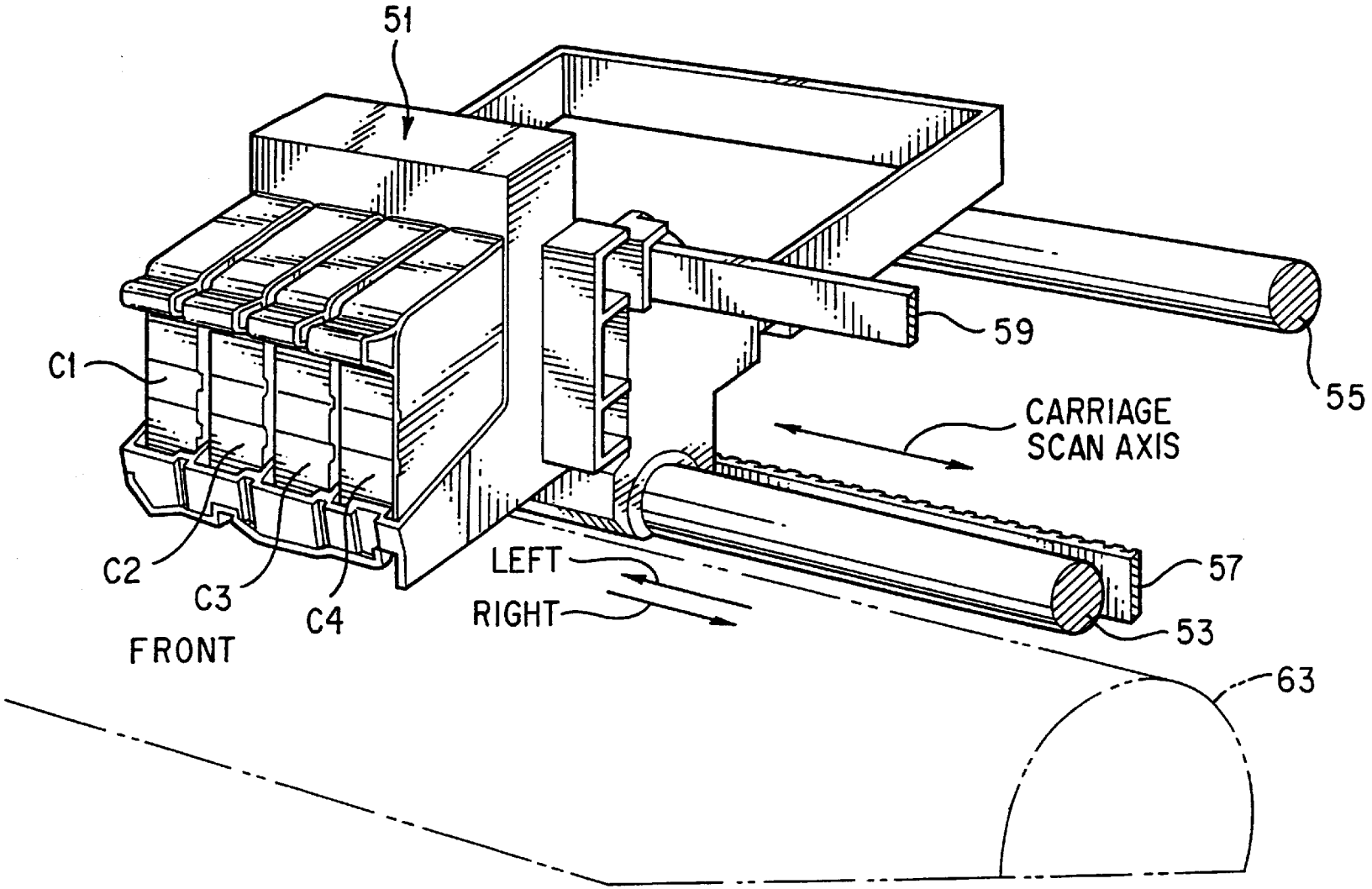
FIG. 9 is a schematic perspective view of the major mechanical components of a thermal ink jet printer employing the disclosed print techniques.

In FIG. 9, there is shown a schematic frontal quarter perspective view depicting, by way of illustrative example, major mechanical components of a multiple printhead ink jet printer in which the techniques of the invention can be implemented. The printer includes a movable carriage 51 mounted on guide rails 53, 55 for translational movement along a carriage scan axis (commonly called the Y-axis in the printer art). The carriage 51 is driven along the guide rails 53, 55 by an endless belt 57 which can be driven in a conventional manner, and a linear encoder strip 59 is utilised to detect position of the carriage 51 along the carriage scan axis, for example in accordance with conventional techniques.

Figure 10:
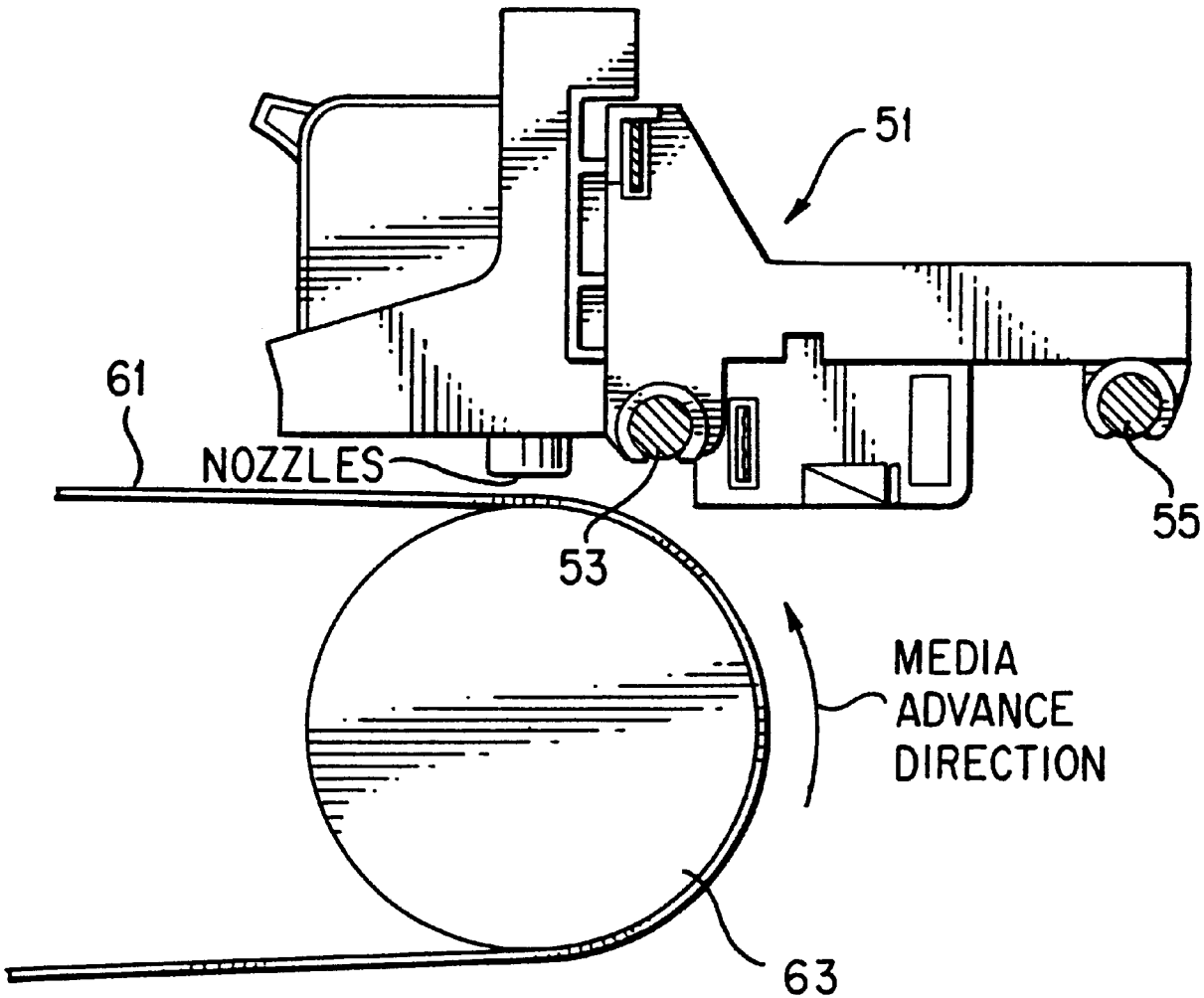
FIG. 10 is schematic side elevational sectional view illustrating the relation between the downwardly facing ink jet nozzles and the print media for the printer of FIG. 9.

The carriage 51 supports four thermal ink jet printhead cartridges C1, C2, C3, C4 (sometimes called "pens," "print cartridges," or "cartridges") which are side-by-side along the carriage axis. As depicted in FIG. 10, the printhead cartridges C1, C2, C3, C4 include downwardly facing nozzles for ejecting ink generally downwardly to a print media 61 which is supported on a print roller 63 that is generally below the printhead cartridges.

For reference, the print cartridges C1, C2, C3, C4 are considered to be on the front of the printer, as indicated by legends on FIG. 9, while left and right directions are as viewed while looking toward the print cartridges, as indicated by labelled arrows on FIG. 9. By way of example, the print media 61 is advanced while printing or positioning so as to pass from beneath the cartridge nozzles toward the front of the printer, as indicated on FIG. 10, and is rewound in the opposite direction.

Figure 11:
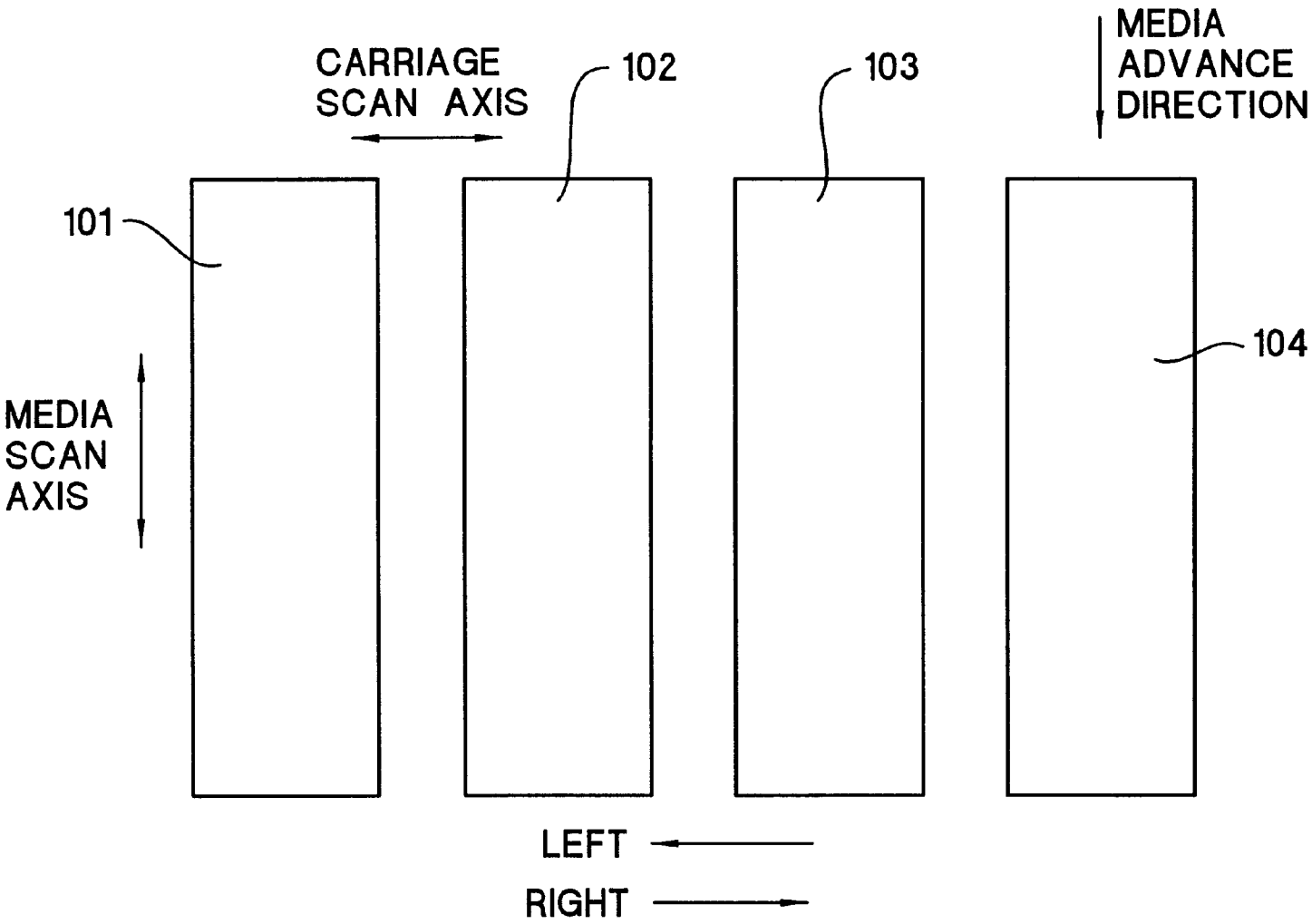
FIG. 11 is a schematic plan view illustrating the general arrangement of the printheads over the print media for the printer of FIG. 9.

The media scan axis as depicted in FIG. 11 is considered as being generally tangential to the print media surface that is below the nozzles of the printhead cartridges and orthogonal to the carriage scan axis. It is noted that the media scan axis is sometimes called the "vertical" axis, probably as a result of those printers having printing elements that printed on a portion of the print media that was vertical. Also, the carriage scan axis is sometimes called the "horizontal axis".

By way of illustrative example, the cartridges C1, C2, C3 comprise non-black colour printing cartridges for producing the base colours of yellow, cyan, and magenta as commonly utilised in colour printing, while the cartridge C4 comprises a black printing cartridge.

FIG. 11 schematically depicts the arrangement of the printing element plates 102, 103, 104 of the cartridges C1, C2, C3, C4 as viewed from above the printing elements of the cartridges (i.e., the print media would be below the plane of the figure).

The printhead cartridges may be implemented in accordance with the embodiments described in U.S. Pat. No. 5,604,519. In these embodiments, each cartridge has a plurality of printing primitives, and each primitive has a group of printing elements which are fired independently in sequence. For brevity, the disclosure of U.S. Pat. No. 5,604,519 is not included explicitly but is incorporated herein by reference. It is assumed that a person skilled in the art of printers would have knowledge and practical experience of this type of printhead arrangement.

However, it is apparent from the foregoing invention summary that the principles and benefits of the invention may also applied to other printhead cartridge implementations. For example, the printhead cartridges may have printing elements arranged in two columns wherein the nozzles of one column are staggered relative to the nozzles of the other column. The distance along the media scan axis between diagonally adjacent nozzles is known as the nozzle pitch, and by way of example is equal to the highest media axis resolution that the printer is capable of printing in a single carriage scan (e.g., 1/300 inch for 300 dpi along the media axis in one carriage scan). In use, the physical spacing between the columns of nozzles in a printhead is compensated by appropriate data shifts in the swath print data so that the two columns function as a single column of printing elements.

In essence, the implementation of the invention is associated with the timing of firing the printing elements in the print cartridge. The timing of firing of the simplified group of printing elements (primitive) illustrated in FIG. 1 will now be described. A person skilled in the art of printers would, without undue burden, be able to extend the concepts described below to more complex primitive structures used in currently available printers, such as the primitives disclosed in U.S. Pat. No. 5,604,519.

Figure 1:
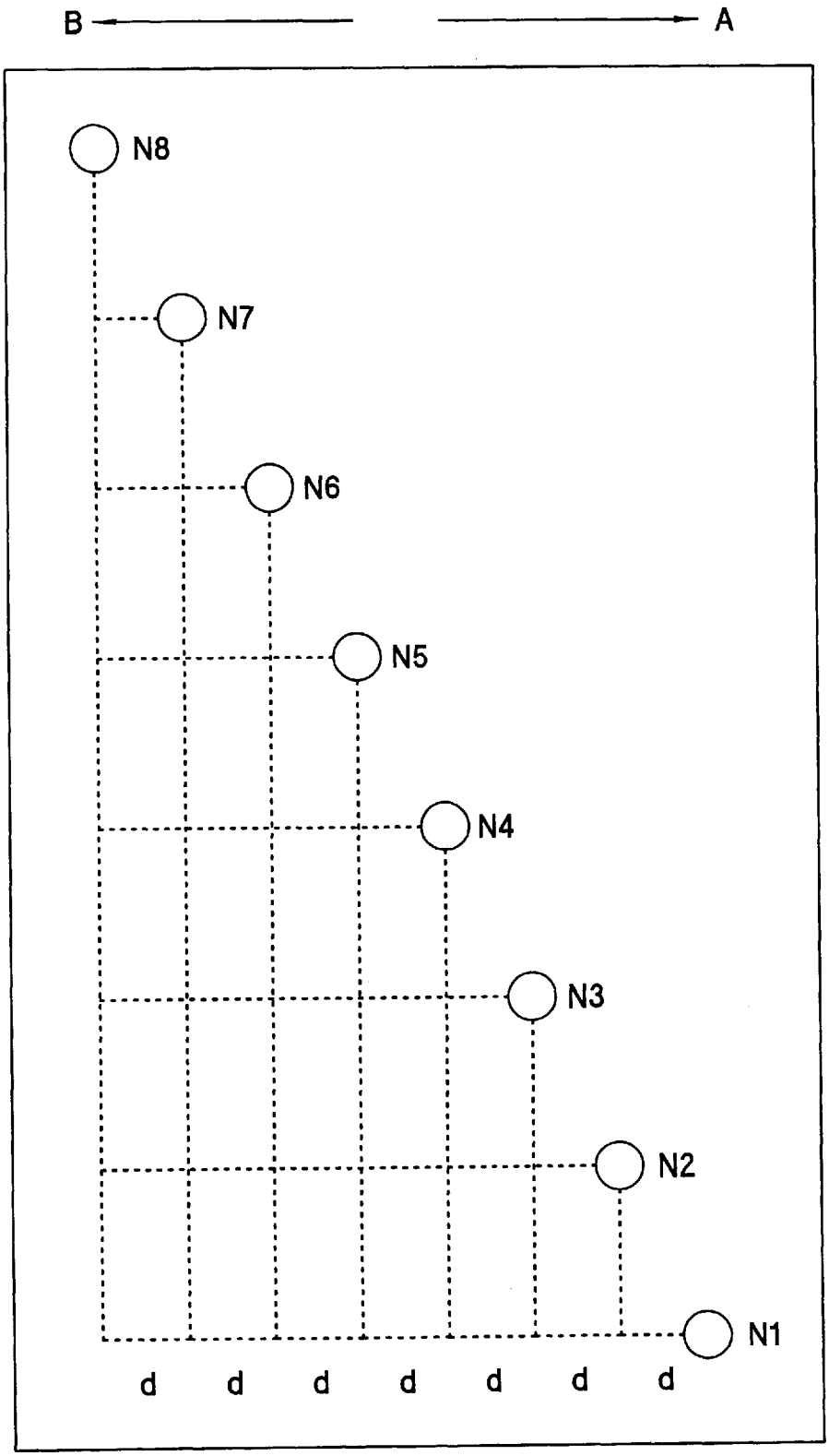
FIG. 1 is a view of a printing primitive from behind the printing nozzles, which illustrates the layout of eight nozzles.

FIGS. 5 to 8 are schematic diagrams of the firing sequences of the printing elements N1 to N8 for the primitive illustrated in FIG. 1. The firing sequences correspond to the primitive moving in the direction of arrow A. When scanning from right to left (arrow B) the firing sequences are reversed. Time is represented on the horizontal axis, as indicated by the time scale at the top of each Figure. The time scale is the same for each and every diagram. The printing elements of the primitive, labelled N1 to N8, are indicated on the left of each Figure. The voltage level on the respective power supply line for each printing element is represented by the lines extending to the right of each label N1 to N8. A raised line represents a raised voltage level, which in turn corresponds to activation of the respective printing element. As previously mentioned, only one printing element from the primitive may be activated at any one point in time.

Firing Sequence for Standard Mode

Figure 5:
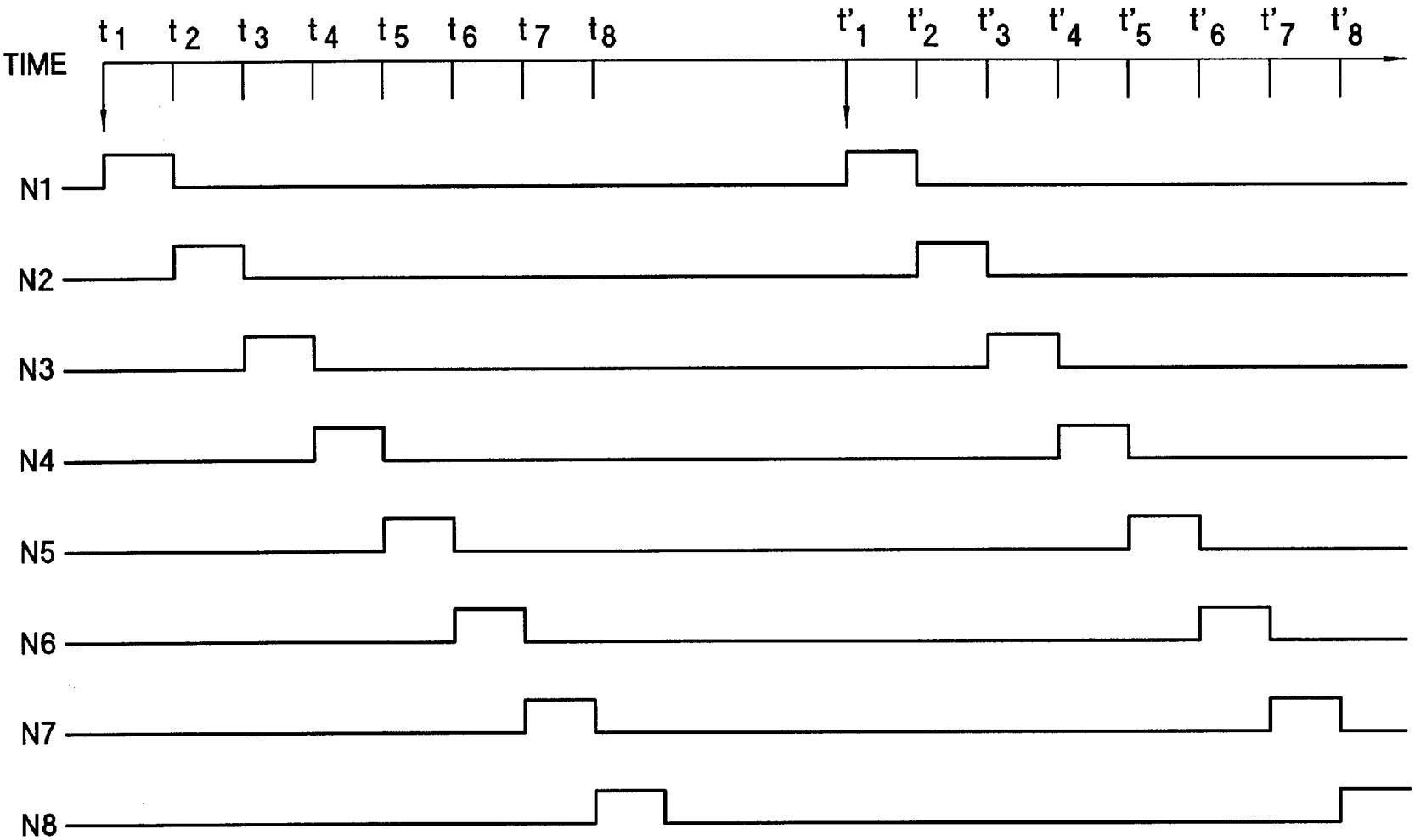
FIG. 5 is a schematic diagram of the firing sequence for printing elements in a printer operating in a standard mode.

FIG. 5 illustrates the repeated sequence for firing the printing elements N1 to N8 in the standard mode. The printable positions resulting from this firing sequence are shown in FIG. 2. The labels on the time scale indicate when a printing element is at the correct position over the print media for printing. The first set of labels $t_1$ to $t_8$ correspond to printing in the first column labelled t in FIG. 2. Similarly, the second set of labels $t'_1$ to $t'_8$ correspond to printing in the second column labelled t' in FIG. 2.

The speed of scanning or printing is limited in this standard mode by shortest period between successive firings of the same printing element, i.e. the maximum firing frequency. This period is indicated in FIG. 5 by the time span between $t_1$ and $t'_1$, or $t_2$ and $t'_2$, etc.

Firing Sequences for Prior Art Draft Mode

Figure 6:
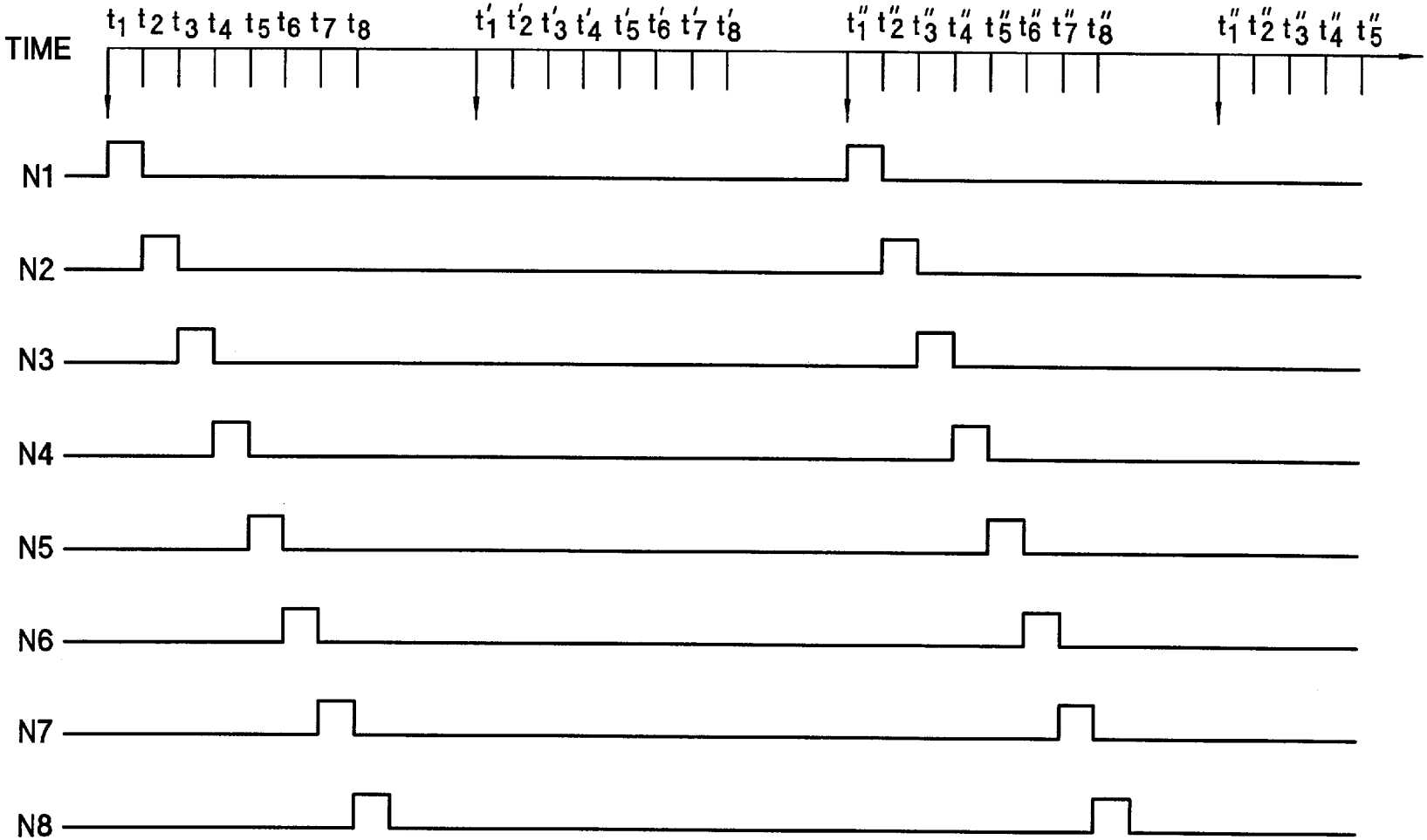
Fig. 6 (Prior Art)
FIG. 6 is a schematic diagram of the potential firing sequence for printing elements in a printer operating in a prior art draft mode.

FIG. 6 illustrates the repeated sequence for firing the printing elements NI to N8 in the prior art draft mode. The printable positions resulting from this firing sequence are shown in FIG. 3. From the spacing of the labels in FIG. 6, it can be appreciated that the speed of scanning the primitive is twice that of FIG. 5. The lack of activation of the printing elements in the t'and t'" columns means that the time span between successive firings of printing elements, e.g. $t_1$ and $t''_1$, or $t_2$ and $t''_2$, remains unchanged. Hence, the maximum firing frequency is not exceeded.

Figure 7:
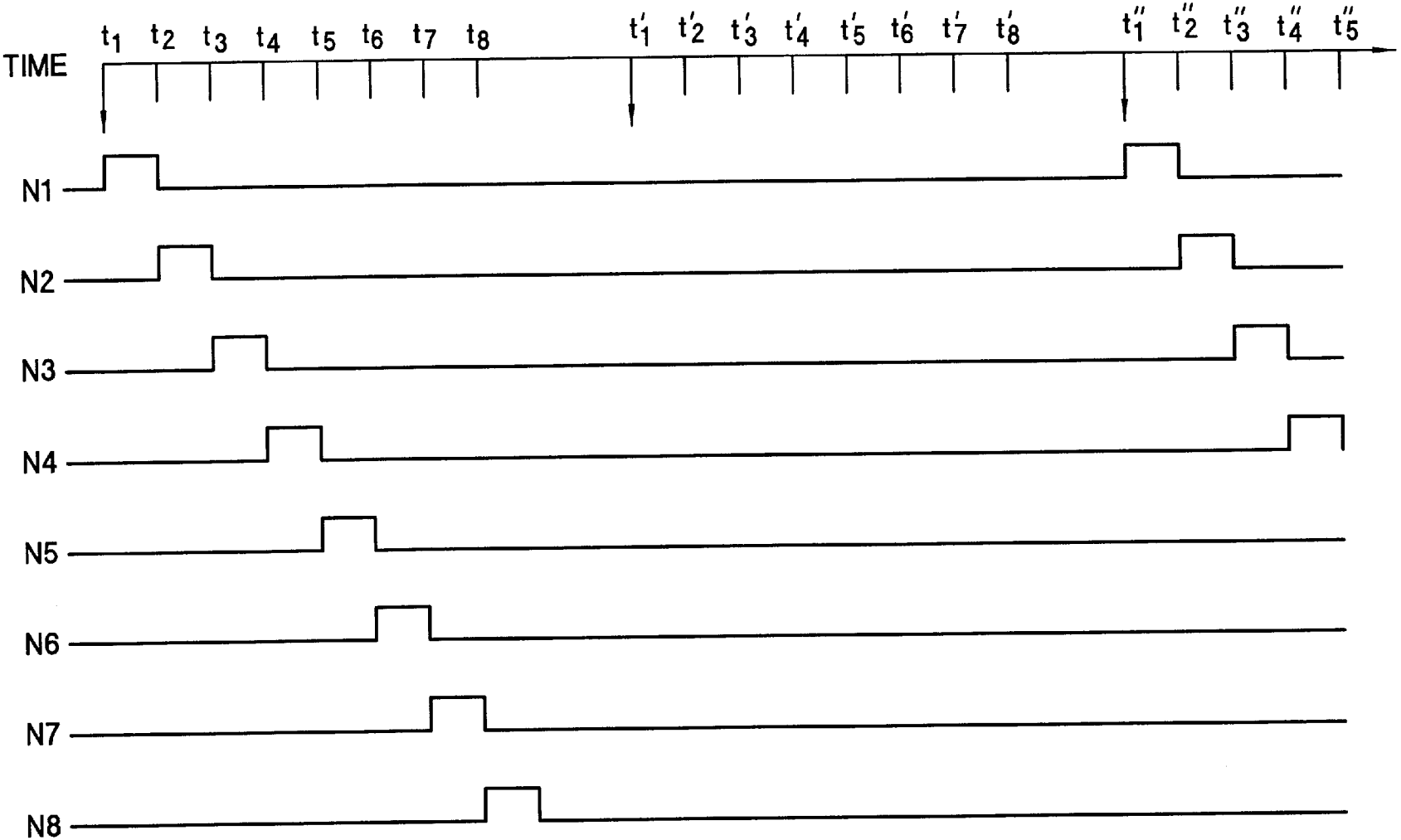
Fig. 7 (Prior Art)
FIG. 7 is a schematic diagram of the firing sequence for printing elements in a printer operating in a prior art draft mode.

In order to accommodate the increased speed of scanning, the activation time of the printing elements has to be halved; otherwise, activation of the printing elements will overlap i.e. more than one printing element will be activated at one time. In this context, the activation time and the firing time of a printing element are generally equivalent because the printer has to print in real time. However, at high printing speeds and high printing resolutions, reduction of the activation time by a half may not possible because the minimum firing time may be exceeded. Consequently, it may not be possible for the speed of scanning in the draft mode to be twice the speed in the standard mode. In other words, the minimum firing time of the printing elements limits the speed of scanning. FIG. 7 illustrates the repeated firing sequence of FIG. 6, in which the scanning speed has been limited by the firing time of the printing elements.

Firing Sequence for Improved Draft Mode

Figure 8:
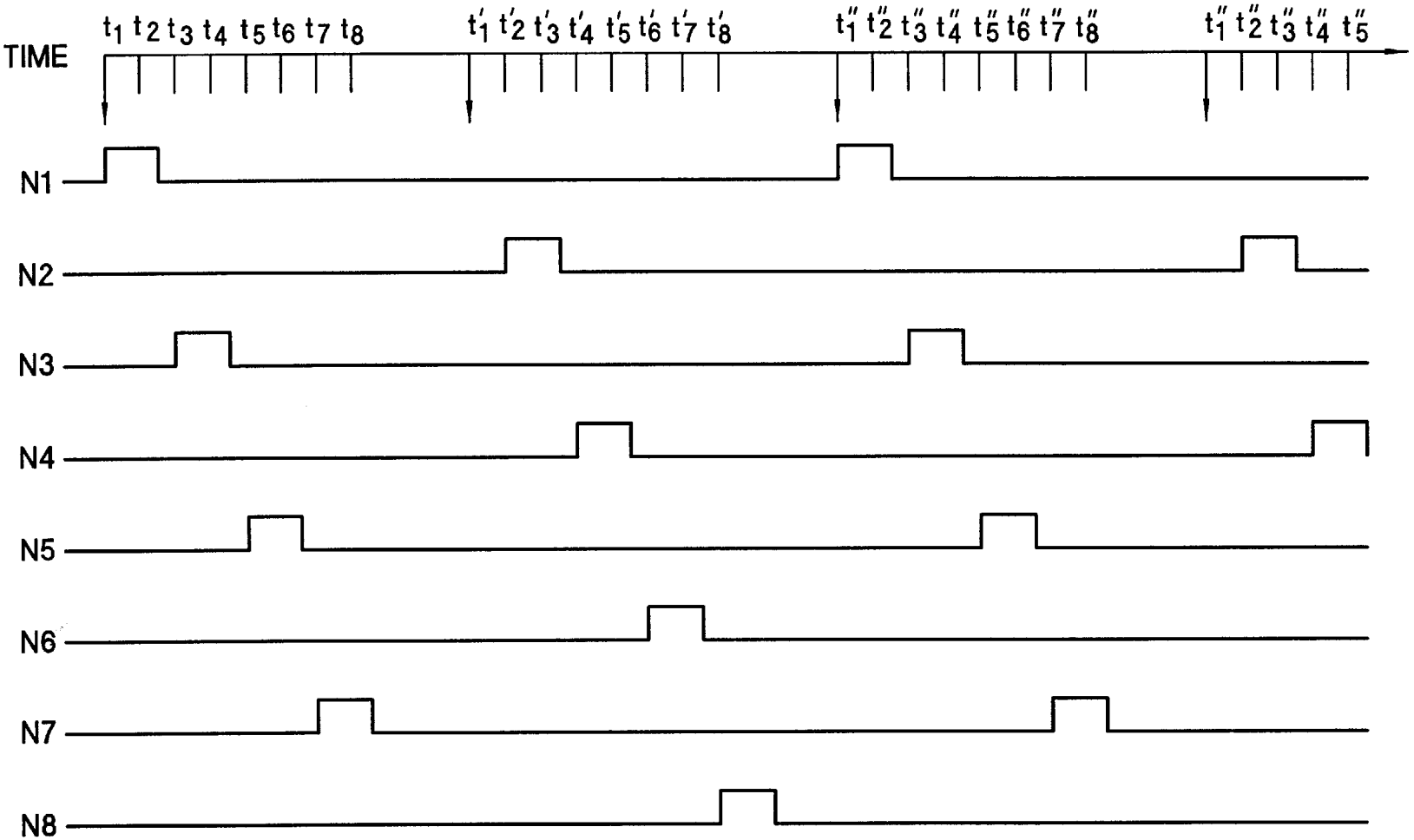
FIG. 8 is a schematic diagram of the firing sequence for printing elements in a printer operating in an improved draft mode in accordance with the invention.

FIG. 8 illustrates the repeated sequence for activating the printing elements N1 to N8 in a improved draft mode in accordance with the invention. The printable positions resulting from this firing sequence are shown in FIG. 4. This improved draft mode is based on activation of the odd numbered printing elements in the first column and every other column thereafter, together with activation of the even numbered printing elements in the interstitial columns, i.e. the second column and every other column thereafter. This activation sequence allows the speed of scanning the primitive to be equal to that of the prior art draft mode shown in FIG. 6 (twice that of FIG. 5), without experiencing the same limitations due to the minimum firing time of the printing elements.

In an alternative improved draft mode in accordance with the invention, the resolution of the printer could be decreased to a third or a quarter of the resolution in the standard mode. In these modes, the individual printing elements would repeat every third or fourth column respectively. For example, in column t, printing elements N1, N4, and N7 could be activated, in column t', printing elements N2, N5, and N8 could be activated, and in column t", printing elements N3 and N6 could be activated, with the cycle repeating again in column t'".

Methods for controlling the timing of activating and firing the printing elements in accordance with the invention may be embodied in a printer or a printer controller in a variety of ways. For example, the method may be embodied in the control circuitry of a printer using hardwiring, electrically erasable programmable read only memory (EEPROM), or an application specific integrated circuit (ASIC).

The arrangement of printable positions available for the improved draft modes are generally spaced in a more homogenous fashion (see FIG. 4). This homogeneous arrangement has the advantage of being more appealing to the eye. Effectively, the reduction in the resolution of the printer occurs in both the scanning direction of the primitive and the feed direction of the print media.

It will be evident in view of the foregoing description that various modifications may be made within the scope of the present invention.

What is claimed is:

1. A method of printing in a printer which has a printing cartridge supporting printing elements that are activated for printing at predetermined column positions, the method comprising;

a) activating a first subset of the group of printing elements so as to print at a first set of predetermined positions along a carriage scan axis, b) activating a second subset of the group of printing elements so as to print at a second set of predetermined positions along the carriage scan axis, and c) alternately repeating the activating steps a) and b) during a single scan of the printing cartridge, whereby the first and second sets of predetermined positions are spatially interleaved.

2. A method of printing in a printer having a printing cartridge which scans along a carriage scan axis and which supports a group of printing elements that are spatially offset from each other in the scanning direction of the cartridge, the method comprising the steps of:

i) selecting to print either in a first printing mode having a first resolution or in a second printing mode having a second, lower resolution;

ii) printing in the first printing mode according to the selection in step i) by sequentially activating the group of printing elements according to a predetermined timing cycle, whilst the cartridge is scanned over a print media, such that the elements print on the print media at substantially the same position along the carriage scan axis, the predetermined timing cycle being repeated during a single scan to selectively print on the print media at a plurality of positions along the scan axis; and iii) printing in the second printing mode according to the selection in step i) by a) sequentially activating a first subset of the group of printing elements according to a first timing cycle such that the first subset of elements selectively print on the print media at a first set of predetermined positions along the carriage scan axis;

b) sequentially activating a second subset of the group of printing elements according to a second timing cycle such that the second subset of elements selectively print on the print media at a second set of predetermined positions along the carriage scan axis;

c) alternately repeating the activating steps a) and b) during a single scan of the printing cartridge as the cartridge scans over the print media to spatially interleave the first and second printing positions on the print media.

3. A method as claimed in claim 2, wherein selective printing on the print media is performed by selectively supplying a control signal to an activated print element.

4. A method as claimed in claim 2, wherein the printing elements are activated one at a time.

5. A method as claimed in claim 2, wherein the step a) is repeated by step c) at a predetermined rate such that the spacing along the carriage scan axis between the first printing positions is substantially equal to twice the spacing between said same positions in the first printing mode.

6. A method as claimed in claim 2, wherein the step b) is repeated by step c) at a predetermined rate such that the spacing along the carriage scan axis between the second printing positions are substantially equal to twice the spacing between said same positions in the first printing mode.

7. A method as claimed in claim 2, wherein the timing between the steps a) and b) is determined such that the spacing along the carriage scan axis between the first and second positions is equal to the spacing between said same positions in the first printing mode.

8. A method as claimed in claim 7, wherein the printing elements are evenly spaced apart from each other in a direction perpendicular to the carriage scan axis, and the spacing is equal to a multiple of the spacing between said same positions in the first printing mode.

9. A method as claimed in claim 2, wherein the printing elements in the first or second subsets are spatially offset from each other by twice the offset of the printing elements in the group.

10. A method as claimed in claim 2, wherein the printer has a plurality of said group of printer elements, each group operating according to the steps a), b) and c).

11. A method as claimed in claim 2, wherein the number of printing elements in the first subset is equal to the number of printing elements in the second subset.

* * * * *